US007647739B2

(12) United States Patent
Boyd

(10) Patent No.: US 7,647,739 B2
(45) Date of Patent: Jan. 19, 2010

(54) SUSPENDED CEILING CONSTRUCTION AND RETAINING CLIP THEREFOR

(76) Inventor: Augustus Ray Boyd, 2720 Meridian Dr., Robbinsdale, MN (US) 55422

( * ) Notice: Subject to any disclaimer, the term of this patent is extended or adjusted under 35 U.S.C. 154(b) by 44 days.

(21) Appl. No.: 12/014,203

(22) Filed: Jan. 15, 2008

(65) Prior Publication Data

US 2009/0178358 A1 Jul. 16, 2009

(51) Int. Cl.
*E04B 9/00* (2006.01)

(52) U.S. Cl. ..... 52/506.05; 52/506.07; 52/506.08; 52/712; 24/545; 24/547

(58) Field of Classification Search ..... 24/293, 24/294, 295, 457, 458, 545, 555, 563, 570, 24/20, 547; 52/506.05, 506.06, 506.07, 204.59, 52/285.5, 489.1, 506.08, 599, 712, 204; 248/227.2, 248/228.7, 231.81, 468, 316.7, 500, 560; 362/147, 364, 365, 366; D19/51, 56; 401/92, 401/93; 403/327, 329; D8/395
See application file for complete search history.

(56) References Cited

U.S. PATENT DOCUMENTS 1,513,353 A * 10/1924 Vanerka ..... 24/530
2,502,680 A * 4/1950 Stewart ..... 177/129
3,248,839 A 5/1966 Roberts
3,512,313 A * 5/1970 Harz ..... 52/28
3,565,473 A 2/1971 Kedel
3,704,563 A 12/1972 Waller
3,834,106 A 9/1974 Astedt
3,875,717 A 4/1975 Moeller
3,934,387 A 1/1976 Moeller
4,027,454 A 6/1977 Schuplin
4,062,164 A 12/1977 Cousins
4,084,364 A * 4/1978 Jones ..... 52/506.07
4,283,891 A 8/1981 Moeller
4,408,428 A 10/1983 Brooke
4,580,387 A 4/1986 Rogers
4,641,987 A * 2/1987 Schlegel ..... 403/169
4,858,408 A 8/1989 Dunn
4,873,809 A 10/1989 Paul
5,392,579 A * 2/1995 Champagne ..... 52/520
5,417,025 A 5/1995 Nute
5,603,193 A 2/1997 Koertge
6,449,917 B1 9/2002 Sullivan
6,665,188 B1 * 12/2003 Chen ..... 361/719
7,062,886 B2 6/2006 Auriemma

OTHER PUBLICATIONS

Standard Handbook for Mechanical Engineers, McGraw Hill Publishing, Tenth Edition, p. 8-67.*

* cited by examiner

*Primary Examiner*—Robert J Canfield
*Assistant Examiner*—Adam Barlow

(57) ABSTRACT

A suspended ceiling construction includes fill-in panels, diffusers and/or light fixtures which are retained in their openings by spring clips that have been pre-attached to the ceiling grid frame members. The clips bear against edges of the panels to keep them in place normally, but they can be deflected out of the way by pushing up on the panels when necessary. As the tips of the clips contact the frame members during deflection, they provide increasing resistance to further deflection.

8 Claims, 4 Drawing Sheets

SUSPENDED CEILING CONSTRUCTION AND RETAINING CLIP THEREFOR

BACKGROUND OF THE INVENTION

This invention relates to a suspended ceiling construction for a clean room and retaining clips for holding removable fill-in panels, diffusers and light fixtures in place. Such elements are referred to below collectively as "removable ceiling components".

In a clean room such as an operating room, the ventilation system must provide breathing air and comfort for the surgical team, and ventilating components must be arranged in the ceiling in such a manner that ceiling mounted operating room equipment and other ceiling penetrations are accommodated without themselves creating a pathway through which particles and microorganisms might enter the operating room. The system must also isolate the patient from as many airborne particles as possible, by employing suppression, dilution and filtration methods.

Research over the last two decades has increasingly shown that a properly designed and installed laminar (or "unidirectional") ventilation system in an operating room or clean room can substantially reduce the number of airborne particles impacting a surgical site in an operating room, and that a correlation exists between the number of airborne particles and the rate of surgical site infections. United States National Institutes of Health (NIH) research has identified design criteria which, when employed in the design of operating room ventilation systems, can control and minimize the number of particles at the incision site. These parameters include air change rate, diffuser selection, filtration diffuser application, and return/exhaust location.

The rate at which air is replaced in a room is important in many clean room situations. Providing a minimum air change rate not only dilutes contaminants in the air, but also keeps the air fresh and minimizes the accumulation of odors. The number of air changes varies, as governed by the local authority having jurisdiction. NIH research has most recently shown that for a general purpose operating room, 20 air changes per hour are optimal. Higher air change rates are sometimes indicated for operating rooms where higher-risk procedures take place. These "ultraclean" operating rooms include orthopedic, bone marrow and large organ transplant rooms and some cardio rooms.

Typically, air enters operating rooms through diffusers. Unidirectional non-aspirating diffusers sometimes also called laminar flow diffusers or laminar flow modules are recommended by ASHRAE as a result of NIH and other research. The type and number of diffusers should be selected so that the resulting average velocity is in the range of 25-35 cubic feet per minute for every square foot of diffuser face. Within this operating range, unidirectional diffusers minimize the number of airborne particles drifting upward from the patient and the surgical team, while also minimizing the number of existing airborne particles blown downward toward the patient's incision.

The cleanest possible system results from a terminal HEPA filter mounted inside the unidirectional flow diffuser. This arrangement prevents any unseen ductwork contamination from entering the room.

If a clean room has a suspended ceiling, consideration must be given to preventing the infiltration of contaminates from the interstitial space above the suspended ceiling. Contamination can occur if a component such as a fill-in panel or a light fixture is unintentionally dislocated, such as during cleaning. To prevent such accidents, ceiling component retaining devices typically are installed from above the ceiling after the components are in place. However, this approach does not allow for subsequent convenient access to the interstitial space because there must be secondary access doors in the ceiling so that one can install or replace the retaining devices. Moreover, because the retaining devices are often damaged or destroyed when a ceiling component is removed, a supply of spare devices must be kept on hand.

Another problem is that when a ceiling component is replaced, the installer faces the problem of how to replace the hold down devices from above the ceiling after the component is in place. He may omit the devices if a secondary access door is not provided close enough to the component.

In general, ceiling component retaining devices should be invisible from the room side of the system to maintain the aesthetics of the system, and to avoid portions exposed on the room side, which might collect dust and result in unsanitary conditions.

It would be beneficial to have a simple retaining device for clean room ceiling panels and fixtures which would normally hold the panel securely in position in the ceiling grid, but would permit it to be removed from below when needed.

SUMMARY OF THE INVENTION

The invention provides component retaining devices which secure ceiling components while permitting convenient access to the space above the ceiling without the need for secondary access doors. The retaining devices are permanently connected to the ceiling grid elements so that components can be removed and installed repeatedly thereafter without damages to the components or to the retaining devices.

The hold down device illustrated is a clip designed to mechanically hold down ceiling components to prevent non-deliberate component dislocation.

An object of the invention is to provide a simple, inexpensive and secure system for holding ceiling components in place, while permitting from their occasional removal without damage.

Another object is to retain ceiling components in a suspended ceiling with devices which are completely hidden.

These and other objects are attained by a suspended ceiling construction and retaining clip therefor, as described below and shown in the drawings.

BRIEF DESCRIPTION OF THE DRAWINGS

In the accompanying drawings.

DESCRIPTION OF THE PREFERRED EMBODIMENT

Figure 1:
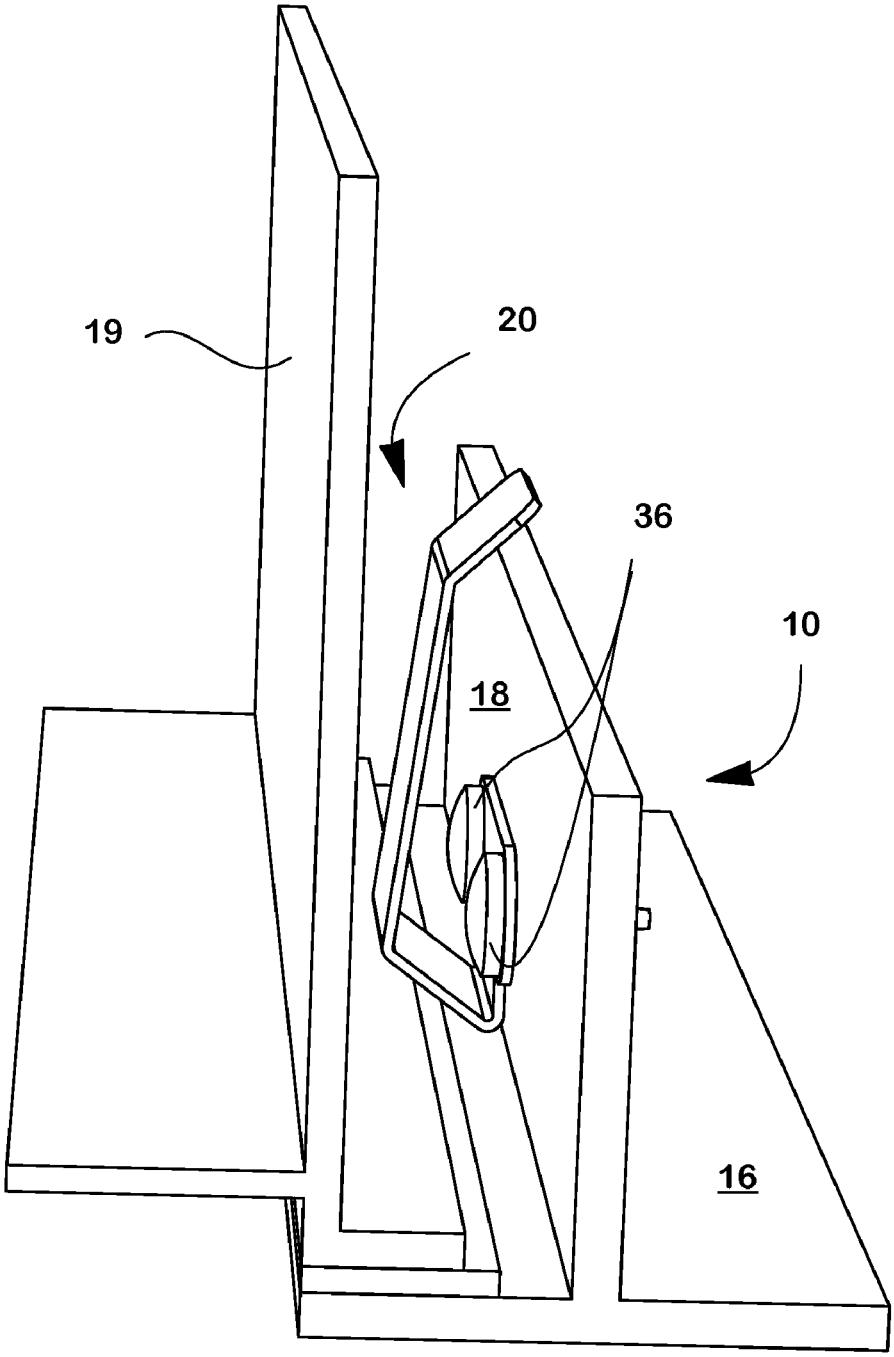
FIG. 1 is a perspective view, from above, of a small portion of a suspended ceiling construction and a retaining clip embodying the invention.

FIG. 1 shows a typical suspended ceiling layout with which this application may be used. The ceiling framing members 10 are suspended by hangers such as wires from a structural ceiling above. Details of the framing members are not part of this invention; however, it may be seen that the framing members have horizontal bottom webs 16 that support the ceiling components, and vertical webs 18 that are connected to the hangers. The vertical webs provide a surface for mounting the clips described below. An edge portion of one ceiling component shown in FIG. 1, designated by reference 19. The illustration of component 19 should be regarded as diagrammatic, since the components may take various forms. In any event, the edge of the component 19 is held down against the horizontal web 16 of the framing member by a retaining clip 20 embodying the present invention.

Figure 2:
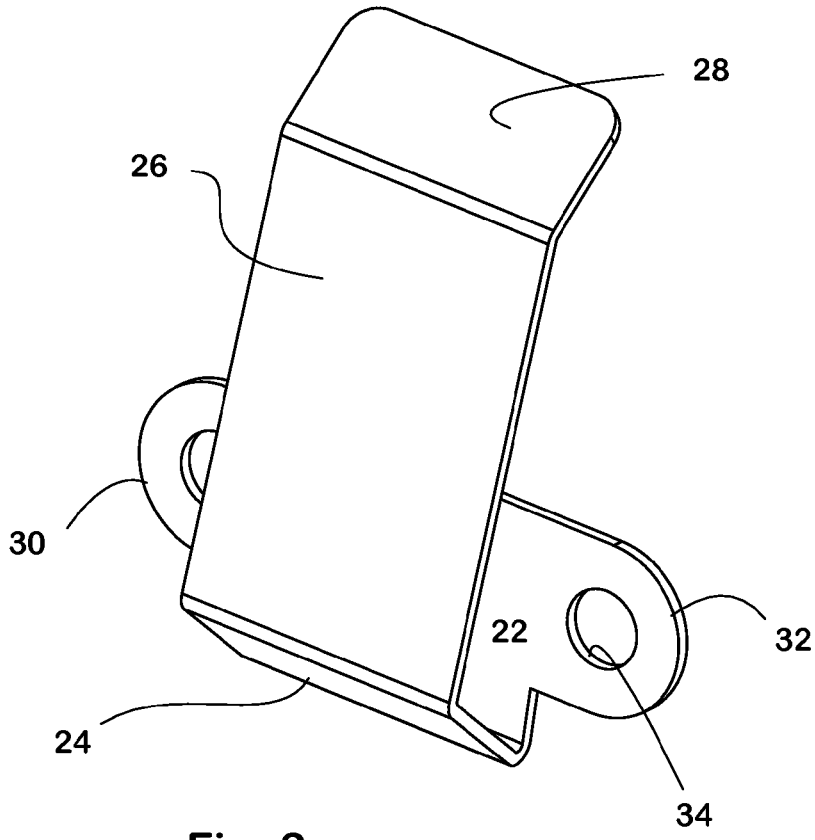
FIG. 2 is a perspective view of the clip.

The ceiling component retaining clip 20, shown in FIG. 2, is formed in a particular shape, described below, to facilitate its positioning on and attachment to the ceiling framing and to allow the placement and removal of ceiling system components while preventing their accidental dislocation.

The clip is formed from a single piece of material, preferably sheet steel (#304 stainless steel or spring steel, 0.03"-0.01" thick) formed by punching a blank from sheet stock and then by bending the blank along three bend lines to define four segments (base segment 22, second segment 24, third segment 26, fourth segment 28) in series at specific angles to one another.

Figure 3:
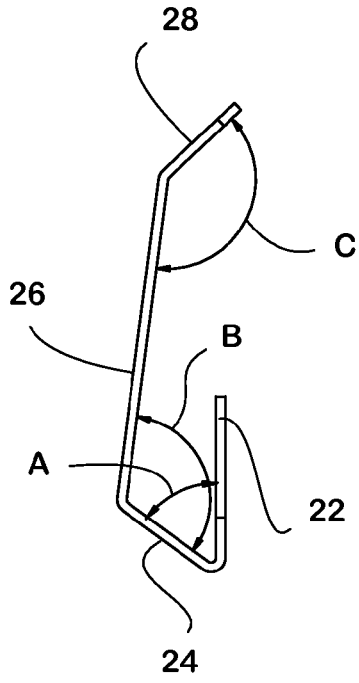
FIG. 3 is a side view thereof.

As FIG. 3 shows, the second segment subtends an acute angle A in the range of 49°-55°, preferably about 52° with the base segment. The third segment subtends an obtuse angle B within the range of 115°-125°, preferably about 120°, with the second segment. The fourth segment subtends an obtuse angle C in the range of 138°-148°, preferably about 143°, with the third segment. The second segment 24 is shorter than the first segment 22 and the third segment 26 is the longest of the four segments.

The clip's material, segment angles, width and thickness are selected so as to produce, when the clip is mounted with its first segment in a vertical orientation, a resistance of at least five pounds when the second segment of the clip is deflected in an upward direction a distance of 0.0625 inch. When four such clips are provided in a grid opening, they therefore together provide a resistance of about twenty pounds to upward displacement of the ceiling component.

The base segment 22 has protruding tabs 30, 32 with a hole 34 in each to act as a template and to accept self-drilling screws 36. It is sized and shaped to position and level the clip during installation. The second and third angled sections 24, 26 are designed and gauged to flex during the placement and removal of components respectively, providing the primary resistance to these actions. The fourth segment 28 is designed to make contact with the vertical portion 18 of the ceiling framing to prevent excessive deformation and to provide increasing resistance to further deformation.

In use, each clip is attached to a ceiling frame element with two screws, as shown in FIG. 1. For each component (fill-in panel, diffuser or fixture), four or more clips are spaced around the component's perimeter. The clips allow the component to be removed deliberately replaced without tools and without damage to the clip or the components. The clips do not require auxiliary access to the space above the ceiling.

Figure 4:
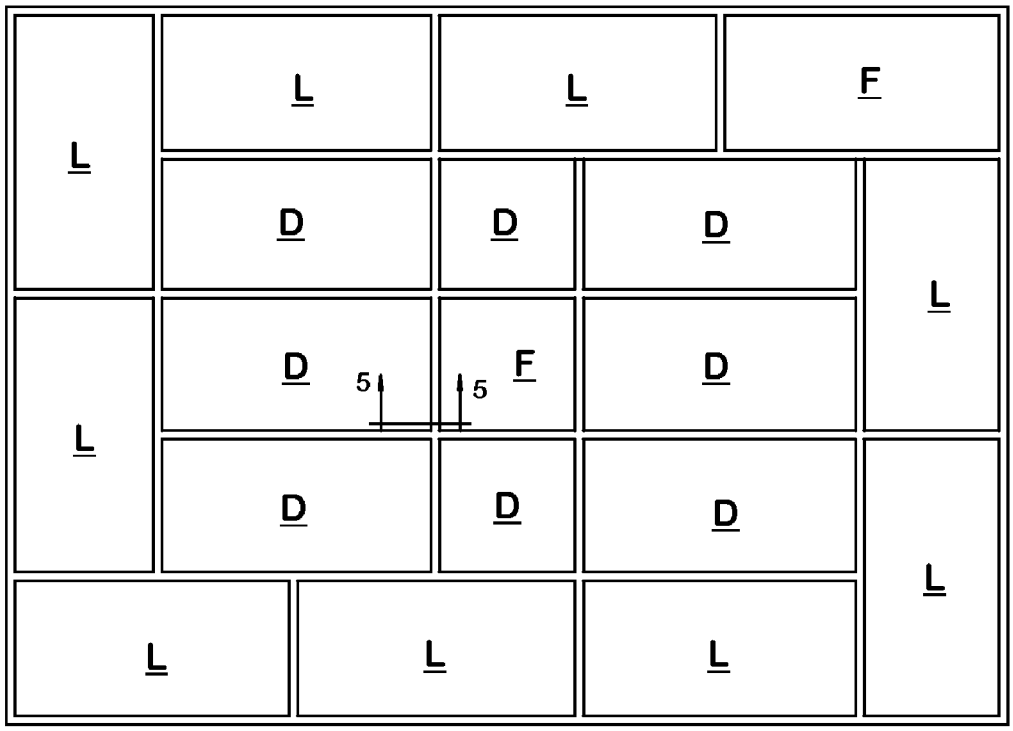
FIG. 4 is a top plan view of a suspended ceiling grid.
Figure 5:
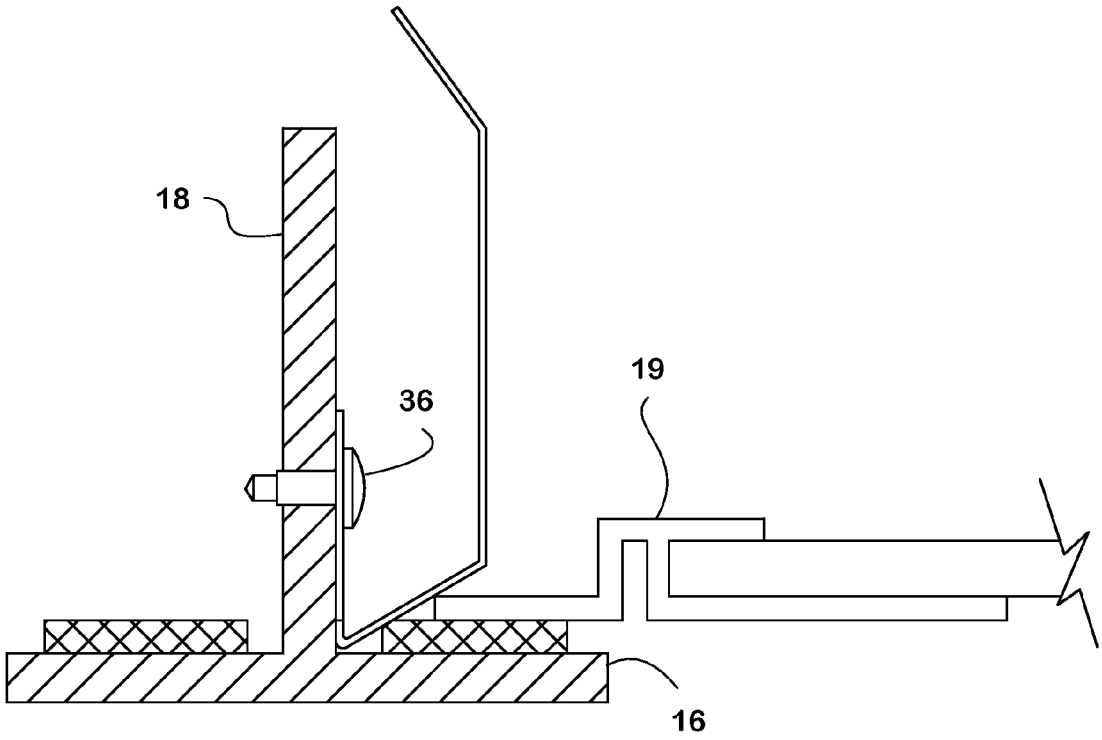
FIG. 5 is a sectional view taken on the plane 5-5 in FIG. 4.

FIG. 4 shows the layout of a typical suspended ceiling for an operating room, where reference "L" designates light fixtures, "D" designates diffuser panels, and "F" designates fill-in panels. The section line in FIG. 4 shows where the sectional view in FIG. 5 is taken.

The clips may be installed in the field without modification to the preferred frame sections. The shape of the clip enables the installer to positions it correctly on the ceiling frame, while self-drilling tech screws create their own mounting holes during installation. This avoids the need for templates, measuring devices and mounting fixtures. The bend angles are precisely formed to maintain contact with the ceiling component flange and to resist removal. As the component is pushed upward, the lower angled section resists component movement until sufficient force is applied to bend the second segment toward the base segment. After the clip deflects sufficiently, the fourth segment contacts with the vertical flange of the ceiling frame section, providing increasing resistance to the movement. This protects the clip from damage and rapidly increases the resistance to additional movement.

It may be appreciated that the clip described above is merely the most preferred form of the invention, and that many design changes may be made to the design without affecting its utility. For example, the choice of material and gauge is a matter for the designer, who will take into account the size and weight of the ceiling components. Also, while the second, third and fourth segments are shown as being of uniform width, they could be contoured. Similarly, which the preferred design has four straight segments, some of the segments, especially the second segment, might be curved.

Since the invention is subject to modifications and variations, it is intended that the foregoing description and the accompanying drawings shall be interpreted as only illustrative of the invention defined by the following claims.

I claim:

1. A suspended ceiling comprising a grid formed from framing members, each framing member having a horizontal web and a vertical web extending upward from the horizontal web, the grid forming an array of openings, a plurality of removable ceiling components filling at least some of the openings in the grid, each said component having an edge portion which rests on part of the horizontal webs of the framing members defining the respective opening, and, at each such opening a plurality of retaining clips for retaining each ceiling component in its opening, each retaining clip comprising a single piece of resilient material forming four segments in series:

a base segment having means for connection to one of the framing members, a second segment subtending an acute included angle with the base segment, a third segment subtending an obtuse included angle with the second segment, and a fourth segment subtending an obtuse included angle with the third segment, wherein the second segment is shorter than the base segment and the third segment is the longest of the four segments.

2. A retaining clip for retaining a removable ceiling component in a suspended ceiling grid formed from ceiling framing members suspended from a structural ceiling, said clip comprising a single piece of resilient material forming four segments in series:

a base segment having means for connection to one of the framing members, a second segment subtending an acute included angle with the base segment, a third segment subtending an obtuse included angle with the second segment, and a fourth segment subtending an obtuse included angle with the third segment, wherein the second segment is shorter than the base segment and the third segment is the longest of the four segments.

3. A retaining clip for retaining a removable ceiling component in a suspended ceiling grid formed from ceiling framing members suspended from a structural ceiling, said clip comprising a single piece of resilient material forming four segments in series:

a base segment having means for connection to one of the framing members, a second segment subtending an acute included angle with the base segment, a third segment subtending an obtuse included angle with the second segment, and a fourth segment subtending an obtuse included angle with the third segment, wherein the second segment is shorter than the base segment and the third segment is the longest of the four segments, wherein the base segment has at least one tab protruding to one side of the clip, each tab having a hole therein for receiving a headed fastener for connecting the clip to one of the framing members, the tab having sufficient size to enable the fastener head to pass the third segment without interference.

4. The retaining clip of claim 2, wherein the clip's material, segment angles, width and thickness are selected so as to produce, when the clip is mounted with its base segment in a vertical orientation, a resistance of at least five pounds when the second segment of the clip is deflected in an upward direction a distance of 0.0625 inch.

5. The retaining clip of claim 2, wherein, in a relaxed position of the clip, the fourth segment does not intersect the plane of the base segment, but the clip can be deflected without plastic deformation to a point where the fourth segment does contact the base segment plane.

6. The retaining clip of claim 2, wherein the acute included angle between the second segment and the base segment is in the range of 49°-55°.

7. The retaining clip of claim 2, wherein the obtuse included angle between the second segment and the third segment is in the range of 115°-125°.

8. The retaining clip of claim 2, wherein the obtuse included angle between the third segment and the fourth segment is in the range of 138°-148°.

* * * * *